United States Patent [19]

Vogel

[11] 3,975,020

[45] Aug. 17, 1976

[54] BOARD GAME APPARATUS

[76] inventor: Charles B. Vogel, 210 Walnut Bend, Houston, Tex. 77042

[22] Filed: May 28, 1975

[21] Appl. No.: 581,630

[52] U.S. Cl. ..... 273/131 AB; 273/131 KC; 273/137 R

[51] Int. Cl.[2] ..... A63F 3/02

[58] Field of Search ..... 273/131, 137

[56] References Cited

UNITED STATES PATENTS

| | | | |
|---|---|---|---|
| 3,761,092 | 9/1973 | Shieff | 273/131 AD |
| 3,764,146 | 10/1973 | Vogel | 273/137 AB |

*Primary Examiner*—Delbert B. Lowe

[57] ABSTRACT

An impoved game apparatus of the type employing sound producing pieces. A sonorous board is employed and the pieces are so constructed that certain ones will produce a concussion of the board by means of a hidden impactor. The concussion causes the board to vibrate, thus producing the sound. The pieces are of such form and appearance that those which will produce sound are not visually identifiable as such. In a first embodiment all the pieces have the same outward appearance but are of different colors on top and bottom faces. In a second embodiment the pieces display the same color on top and bottom but are constructed so as to produce sound in only one orientation, which is not visually identifiable. In a third embodiment each piece is colored on one face only and is supported upon the board by a compliant body. The impactor is concealed within the compliant body on certain pieces only.

11 Claims, 9 Drawing Figures

INVENTOR.

BY
CHARLES. B. VOGEL

INVENTOR.

BY

CHARLES B. VOGEL

BOARD GAME APPARATUS

CROSS-REFERENCES TO RELATED APPLICATIONS

The invention described in this application is an improvement over types of game apparatus described in application Ser. No. 817,116 filed Apr. 17, 1969, now U.S. Pat. No. 3,697,076 and in application Ser. No. 111,238 filed Feb. 1, 1971, now U.S. Pat. No. 3,764,146.

DESCRIPTION OF THE PRIOR ART

In the above referenced patents are described types of game apparatus comprising a multiplicity of playing pieces having a multiplicity of piece identifying colors and so constructed that certain ones only will produce sounds in response to finger pressure applied to an upper surface. The referenced pieces are given such form and outward appearance that those which produce sounds are not visually identifiable as such. In the referenced patents various games are described wherein the rank of a particular piece and its resulting disposition are determined by whether or not it produces sound.

In the referenced prior art apparatus the number of sound producing pieces of any one color is predetermined, which somewhat reduces the element of chance in some games. Also, the sounds produced by the pieces are in some cases not as loud as would be desirable when the pieces are used by those with impaired hearing.

SUMMARY OF THE INVENTION

The above limitations of the prior art are overcome by the present invention, which has as a main objective to provide pairs of pieces wherein each piece has a different color on each of two opposite faces. In this way two identifiable groups of pieces may be assembled, each containing an unknown number of sound producers.

According to a different aspect of the invention, a further objective is to provide sound producing pieces wherein the sound is enhanced by vibration of the playing surface on which the pieces are placed, and by air-borne sound produced by relatively undamped vibration of lower surfaces of the sound producers.

An additional objective is to provide pieces such that the sound producers are not identifiable by kinesthetic observation.

In what is considered the best of the preferred embodiments, the playing pieces are provided as 24 square, parallelepipedous members. Each piece has extended red and blue faces, and a piece may be placed upon a playing surface with either face directed upward. The pieces contain concealed sound producing mechanisms which may or may not produce sound when a particular piece is impulsively pushed by downward directed finger pressure, depending upon which piece is pushed and in some cases depending upon the orientation of the particular piece. Before a game the pieces may be shuffled about and then each of two players may select half the pieces. One player orients his pieces so red faces are directed upward, while his opponent orients his pieces so that blue faces are upward. Since the sound producing mechanisms are concealed, neither player knows the number or positions of his sound producers.

The sound producing mechanisms comprise hard impactors concealed within compressible bodies positioned between the faces of individual pieces. The impactors are arranged so that they cause simultaneously the emission of airborne sound by the pushed piece and concussion of the playing surface beneath the pushed piece. The concussion causes the surface to vibrate, thus enhancing the loudness and audibility of the sound.

The horizontally extended masses are so formed that gradual downward pressure on a piece will be limited before the impactor becomes effective, so that there can be no covert kinesthetic observation of whether a piece is sound producing.

DESCRIPTION OF SPECIFIC EMBODIMENTS

Figure 1A:
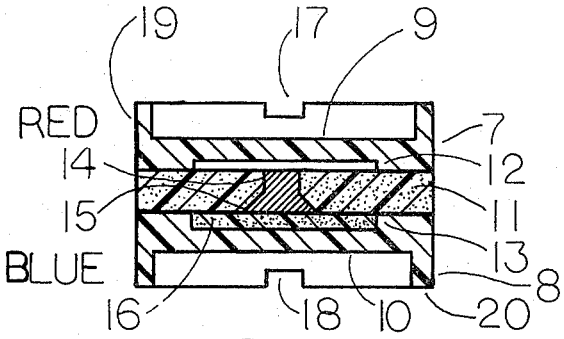
FIG. 1A is a cross section view of a first type of playing piece according to a first embodiment of the invention.
Figure 1B:
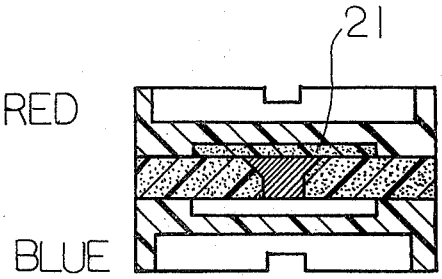
FIG. 1B is a cross section view of a second type of playing piece according to a first embodiment of the invention.
Figure 1C:
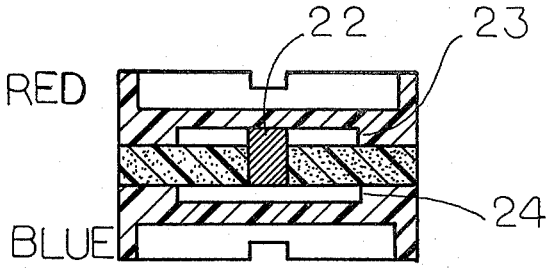
FIG. 1C is a cross section view of a third type of playing piece according to a first embodiment of the invention.
Figure 1D:
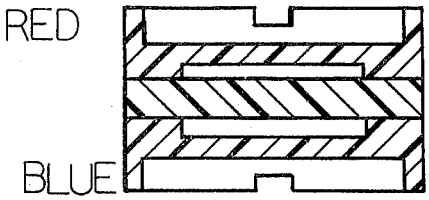
FIG. 1D is a cross section view of a fourth type of playing piece according to a first embodiment of the invention.
Figure 1E:
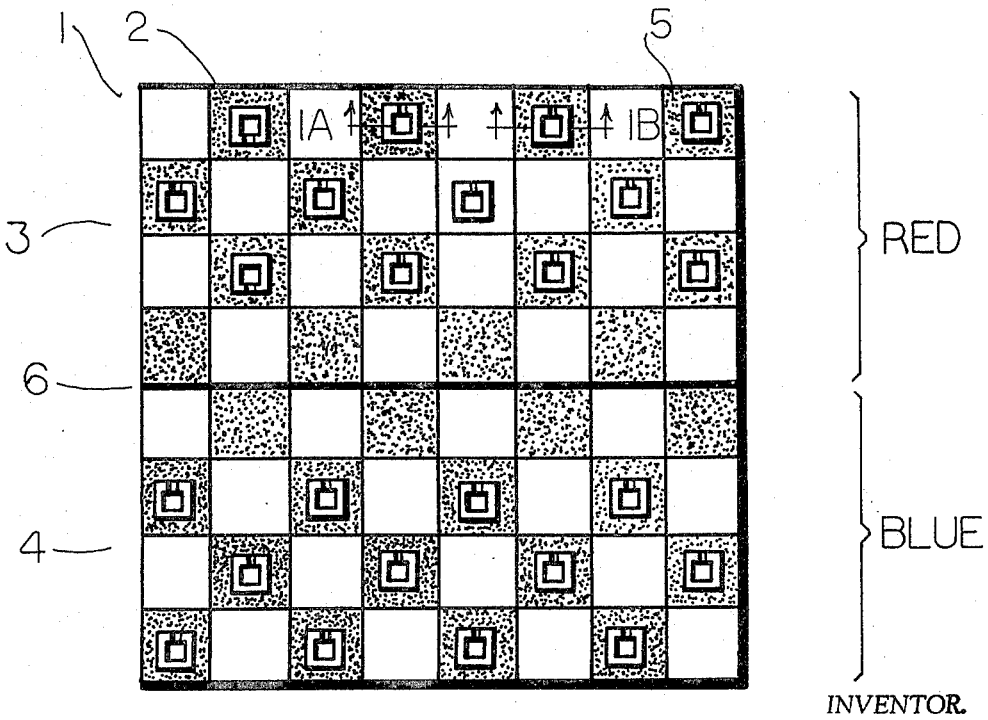
FIG. 1E is a plan view of the playing pieces of the first embodiment of the invention, showing the pieces in place upon the surface of a rigid sonorous playing board at the beginning of a game.

Referring to FIG. 1E, at 1 is shown a playing board constructed of a rigid sonorous material such as wood or stiff fibre board. The board is divided by lines into a matrix of playing spaces as at 2, the playing spaces being colored black as on a checker board. At the beginning of a game the pieces are placed on the board as shown in FIG. 1E. Twelve pieces are used by each player; the total number is thus 24 pieces. Each piece has two faces, one red and one blue. At the beginning of a game to be played on a board, such as "roulette checkers", described below, one player selects twelve pieces and sets the red faces upward as on the half of the playing board indicated at 3. The other player sets the blue faces upward on his half of the board, as indicated at 4. The pieces are placed within the playing positions during play as indicated at 5. A central dividing line 6 divides the playing board into two halves.

Referring to FIGS. 1A, 1B, 1C and 1D, there are illustrated four types of playing pieces of which the first illustrative embodiment of the invention is comprised. The apparatus of the first embodiment comprises 24 pieces: eight pieces as at 1A; eight pieces as at 1B; four pieces as at 1C; four pieces as at 1D. Each piece, as indicated on the figures, has two opposite faces: one red face and one blue face.

Referring to FIG. 1A, the piece comprises a first horizontally extended rigid sonorous mass 7 and a second such mass 8. These masses 7 and 8 may be of polystyrene or other suitable plastic material. The mass 8 is colored blue, while mass 7 is colored red. The outward facing areas of the masses 7 and 8 as at 9 and 10 are referred to herein as the oppositely directed faces of the playing piece. By means of the colors, the red face may be identified as a first face 9, while the blue face may be identified as a second face 10. Sandwiched between the two masses 7 and 8 and attached thereto by epoxy or other suitable adhesive is a compressible body 11 which is made of polyurethane foam of low density such as is used for packaging fragile articles for postal shipment. The upper and lower masses are of identical shape and each has a shallow cup-shaped depression as at 12 and 13. Extending through a hole through the center of the body 11 is a flanged metal rivet of iron or other heavy, dense material. The rivet is 14. The flange 15 is held in place by a flat piece of polyurethane foam 16, which is an acoustical isolator. The rivet 14 is an impactor which will impact upon the mass 9 if impulsive or sudden finger pressure is applied to the upward directed face of the piece while it is sitting upon the surface of the playing board 1 or upon any other rigid sonorous surface. The parts of the playing piece of FIG. 1A are of square shape when viewed from above, so that the piece is a square parallelopiped roughly. The first and second masses 7 and 8 have respectively notches or openings 17 and 18, whereby the face of the piece is ventilated when directed downward, so that any vibration of the downward directed face upon impact will be airborne as sound to the outer air and thereby to the ears of players. The vertical extent of the rivet 14 is such that it is less than the combined vertical extents of the vertical depressions 12 and 13, so that sustained finger pressure will produce a deformation of the compressible body which is limited by the extent of the depressions, so that such sustained pressure will not provide a kinesthetic indication of the presence or absence or orientation of the rivet 14 within the piece. Vertically extended separating rims 19 and 20 on the faces of the piece serve to prevent the faces from contacting completely the playing surface, so that any vibrations of the faces will be substantially undamped by the playing surface.

The playing pieces illustrated at FIG. 1A will produce a loud knocking or clicking sound when the second mass is facing upward and one of the players applies sudden or impulsive finger pressure to the upward directed face. Under these conditions the downward face is struck by the impactor and is caused to vibrate. The vibration causes airborne sound to be produced and carried to the outer air by means of the ventilation provided by the notch 17. Simultaneously, there is transmitted to the playing surface on which the piece sits a concussion which causes the playing surface to vibrate, thus enhancing the produced sound. If the piece is inverted, only a weak, or no, sound is produced because the struck mass is now damped by the pushing finger and concussion is very ineffectively transmitted to the playing surface through the acoustical isolator 12 and the compressible body 11.

Referring to FIG. 1B, the piece there illustrated is of exactly the same construction as is the piece of FIG. 1A, except that the position of the acoustical isolator, shown here at 21, is now placed near the first, or red mass; and the head of the rivet is now placed near the first mass.

Referring to FIG. 1C, the piece there illustrated has exactly the same constructon as that of FIG. 1A, except that the acoustical isolator is omitted and a cylindrical piece of heavy metal, such as iron, is substituted for the rivet. The cylindrical piece of metal 22 is of vertical extent greater than the combined vertical extents of the depressions 23 and 24, so that a player may detect the presence of the metal impactor 22 by covertly and slowly pushing down upon the piece illustrated in FIG. 1C.

Referring to FIG. 1D, the playing piece there illustrated is of exactly the same construction as is the piece of FIG. 1C, except that the impactor 22 is omitted. By slowly pushing on the piece a player may covertly detect the absence in the piece of an impactor such as that at 22.

The pieces of FIGS. 1A, 1B, 1C, 1D and 1E have now been described. The pieces may be used to play a game called "roulette checkers", which is described in the referenced patents. The game is played in a manner similar to that of the common game checkers, except that the pieces are subject to challenge. In a challenge play one of the players taps one of his pieces and then taps an opponent piece. If they both behave in the same way with respect to the production of sound, then the opponent piece is removed from the board. In any event, a player cannot both move a piece and challenge.

The pieces may also be used to play other games described in the referenced patents. When "roulette checkers" is played, the game is most interesting when all the 24 pieces are used, but a minimal game may be played using a smaller number of pieces. An interesting game which may be played with four pieces will now be described more or less as outlined in above referenced U.S. Pat. No. 3,764,146.

Two pairs of pieces are used. Each player in turn serves as dealer and places before his opponent two pairs of the above described playing pieces selected and oriented so that two are sound producing and two are not, and so that the visual appearance of the pieces does not reveal which are sound producing. Then the opponent wagers some number of scoring points that he will exactly twice correctly predict whether particular pieces will produce sound as he applies impulsive finger pressure to each in turn. After each application of pressure, the wagering player has the option of increasing the number of scoring points wagered. If the wagering player fails to predict correctly exactly twice out of four tries, he loses. Otherwise he wins the scoring points wagered. Either player may concede after any one of the wagers. When a player loses, what he loses are the wagered scoring points, which go to the dealer. When a player concedes, he loses to his opponent the scoring points wagered before he conceded. The players rotate positions of wagerer and dealer and that player is final winner who has the larger score after each has been dealer three times.

Figure 2A:
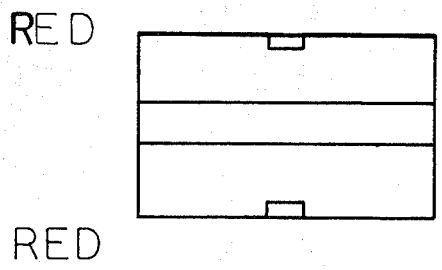
FIG. 2A is an elevation view of a first type of playing piece according to a second embodiment of the invention.
Figure 2B:
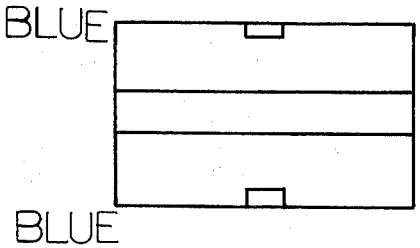
FIG. 2B is an elevation view of a second type of playing piece according to a second embodiment of the invention.

Referring to FIGS. 2A and 2B, elevation views are shown of pieces having the same construction as do the pieces of FIG. 1A, except that twelve of the pieces are red on both faces and twelve of the pieces are blue on both faces. Twenty four pieces are provided and they may be used in an obvious manner to play the above described games.

Figure 3A:
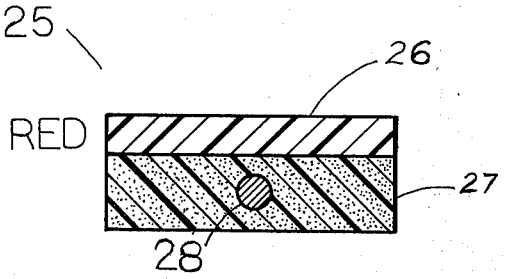
FIG. 3A is a cross section view of a first type of playing piece according to a third embodiment of the invention.
Figure 3B:
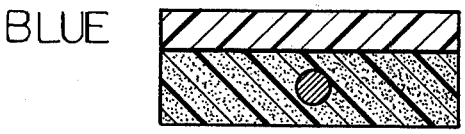
FIG. 3B is a cross section view of a second type of playing piece according to a third embodiment of the invention.

Referring to FIGS. 3A and 3B there are here illustrated by cross section views the construction of a third embodiment of the invention which is especially advantageous in being easily constructed at low cost. The piece 25 comprises an upper rigid part which is of ceramic tile colored red and a lower compressible part 27 which is of foam polyurethane of low density. The piece has the outward shape of a suare parallelepiped. Embedded in the foam polyurethane is a sphere of steel or iron 28. When a player impulsively pushes down on the rigid part 26 while the piece rests upon a surface of sonorous rigid material such as provided by the board of FIG. 1E, then a knocking sound is produced. The piece illustrated at FIG. 3B has the same construction as does the piece of FIG. 3A, except that the upper part is blue. There are provided six pieces as at FIG. 3A and six pieces as at FIG. 3B. In addition there are provided six pieces as at FIG. 3A, except that the sphere is omitted; and six pieces as at FIG. 3B except that the sphere is omitted. The pieces may be used to play the above described and referenced games in an obvious manner.

What is claimed is:

1. Game apparatus comprising pairs of visually identical playing pieces wherein each of said pieces of each pair is a member formed to stand with stability upon a horizontal surface while supported thereon by either of two oppositely directed faces of said member, the improvement comprising:

exterior form and color imparted to said member such that said faces are visually identifiable as a first particular face and a second particular face;

on a first particular member only of each pair of said pieces first indicating means effective to produce a particular distinctive sound in response to application of impulsive finger pressure to said first face of said first particular member while the pair rests upon said surface;

on a second particular member only of said pair second indicating means effective to produce said sound in response to application of said pressure to said second face of said second particular member while the pair rests upon said surface;

whereby said pieces may be oriented to constitute a first group in which each of the pieces exhibits said first face upward and a second group in which each of the pieces exhibits said second face upward;

and whereby in the absence of said pressure said groups provide no conclusive visual information as to locations of those of said pieces which are oriented to produce said sound.

2. The apparatus of claim 1; said first and said second means comprising:

a first horizontally extended rigid sonorous mass connected to said first face;

a second horizontally extended rigid sonorous mass connected to said second face;

a compressible body sandwiched between and connected to said masses;

an impactor positioned within said body and formed to extend part way between said masses;

on said first particular member first space maintaining means connected to said impactor and to said body and effective to maintain a first air filled space extending from the impactor to said first mass in the absence of said pressure;

on said second particular member second space maintaining means connected to said impactor and to said body and effective to maintain a second air filled space extending from the impactor to said second mass in the absence of said pressure;

on the first particular member a first compressible acoustical isolator positioned between the impactor and said first mass and concealed by said body;

on the second particular member a second compressible acoustical isolator positioned between the impactor and the second mass and concealed by said body;

connected to each of said faces vertically extended ventilated separating means effective to maintain a separation between said surface and said faces when the faces are downward directed and effective to provide access for application of said pressure when the faces are upward directed;

and motion limiting means positioned between the masses and effective to limit motion of the masses and thereby to prevent the impactor from contacting both of the masses simultaneously;

whereby said sound is produced by vibration of a downward directed one of said faces and by vibration of said surface but only when said pressure is applied to an upward directed one of said faces which is isolated from an adjacent one of said masses by one of said isolators;

and whereby said limiting means prevents said groups from providing kinesthetic information as to said locations of those of the pieces which are oriented to produce said sound.

3. The apparatus of claim 2; and a horizontally extended playing board which comprises a matrix of playing spaces and is divided into equal halves by a central dividing line.

4. Game apparatus comprising pairs of visually identical playing pieces wherein each of said pieces of each pair is a member formed to stand with stability upon a horizontal surface while supported thereon by either of two oppositely directed faces; and exterior form and color imparted to said member such that said faces are visually identifiable as a first particular face and a second particular face;

on a particular member only of said pair indicating means effective to produce a particular distinctive sound in response to application of impulsive finger pressure to either face of said particular member while the member rests upon said surface whereby said pieces may be oriented to constitute a first group in which each of the pieces exhibits said first face upward and a second group in which each of the pieces exhibits said second face upward;

and whereby said groups provide no conclusive visual information as to locations of those of said pieces which are oriented to produce said sound.

5. The apparatus of claim 4; and a first horizontally extended rigid sonorous mass connected to said first face;

a second horizontally extended rigid sonorous mass connected to said second face;

a compressible body sandwiched between and connected to said masses;

on said particular member only an impactor positioned within said body and formed to extend part way between said masses;

whereby on said particular member only said impactor is effective to impart concussions to said surface and thereby to produce said sound in response to said application of pressure and whereby said sounds are amplified by vibrations of said surface.

6. Game apparatus comprising a multiplicity of playing pieces and a multiplicity of concealed indicating means on said pieces, wherein each of said pieces is a member which comprises two horizontally extended oppositely directed faces and is formed to stand with stability upon a horizontal surface while one of said faces is in contact with said surface, wherein said indicating means are effective to produce different unpredictable sequences of a distinctive transient sound and absence of said sound in response to different sequences of applications of impulsive finger pressure to particular uppermost directed ones of said faces while said contact is maintained, wherein such exterior form and color are imparted to said pieces and said indicating means are so positioned and so constructed that no conclusive visual information is provided as to what sequence of said sound and said absence of sound will be produced in response to a particular sequence of said applications of finger pressure, for at least one viewing direction for each of said pieces, wherein the member comprises a horizontally extended rigid mass which provides a first particular one of said faces and a horizontally extended compressible body which connects said mass to a second particular one of said faces, the improvement comprising:

percussion imparting means concealed witnin said body and so positioned and constrained as to impart a concussion to said surface and thereby to produce said sound in response to said applications of pressure;

whereby said sound is amplified by vibration of said surface.

7. The apparatus of claim 6, wherein said form and color are such as to render said pieces visually indistinguishable;

said means comprising on each of said pieces;

a second horizontally extended rigid sonorous mass connected to said body and providing said second particular one of said faces;

an impactor positioned within said body and formed to extend part way between said horizontally extended masses;

on the member space maintaining means connected to said impactor and to said body and effective to maintain an air filled space extending from the impactor to said second mass in the absence of said pressure;

on the member a compressible acoustical isolator positioned between the impactor and said mass providing said first particular one of said faces;

connected to each of said faces vertically extended ventilated separating means effective to maintain a separation between said surface and said faces when the faces are downward directed and effective to provide access for application of said pressure when the faces are upward directed;

whereby said sound is produced by vibration of a downward directed one of said faces and by vibration of said surface but only when said pressure is applied to an upward directed one of said faces which is isolated from an adjacent one of said masses by said isolator.

8. The apparatus of claim 7; and motion limiting means positioned between said masses and effective to limit motion of the masses and thereby to prevent the impactor from contacting both of the masses simultaneously;

whereby said limiting means prevents said pieces from providing kinesthetic information as to locations of those of said pieces which are oriented to produce said sound.

9. The apparatus of claim 8; and a horizontally extended rigid sonorous playing board which comprises a matrix of playing spaces and is divided into equal halves by a central dividing line.

10. The apparatus of claim 6;

said second paritcular one of said faces being provided by a horizontally extended unattached area on said body; and said percussion imparting means comprising a hard impactor so positioned within said body and so sized as to extend part way between said mass and said second face.

11. The apparatus of claim 10; and a horizontally extended playing board which comprises a matrix of playing spaces and is divided into equal halves by a central dividing line.

* * * * *